US007485054B2

(12) United States Patent
Rigoli

(10) Patent No.: US 7,485,054 B2
(45) Date of Patent: Feb. 3, 2009

(54) TWO PIECE SPORTS EQUIPMENT STICK WITH INTERNAL TRUSS CONSTRUCTION AND VENTED HANDLE

(76) Inventor: Michael Rigoli, Isolation Technologies, 4 Business Way, Hopedale, MA (US) 01747

( * ) Notice: Subject to any disclaimer, the term of this patent is extended or adjusted under 35 U.S.C. 154(b) by 0 days.

(21) Appl. No.: 11/452,158

(22) Filed: Jun. 13, 2006

(65) Prior Publication Data

US 2007/0287561 A1 Dec. 13, 2007

(51) Int. Cl.
*A63B 59/02* (2006.01)
*A63B 65/12* (2006.01)

(52) U.S. Cl. ..... 473/513; D21/724

(58) Field of Classification Search ..... 473/512–513, 473/505; D21/724
See application file for complete search history.

(56) References Cited

U.S. PATENT DOCUMENTS 2,086,062 A * 7/1937 Bray ..... 473/302
2,120,280 A * 6/1938 Hall ..... 473/550
2,635,280 A * 4/1953 Baca ..... 16/431
2,835,245 A * 5/1958 Morgan ..... 126/208
4,082,276 A * 4/1978 Szafianski ..... 473/550
4,108,436 A * 8/1978 Masi ..... 473/538
4,407,500 A * 10/1983 Hofmann ..... 473/550
5,397,123 A * 3/1995 Huang ..... 473/550
5,551,689 A * 9/1996 Svoma et al. ..... 473/535
5,669,835 A * 9/1997 Tiura ..... 473/550
6,149,538 A * 11/2000 Tiura ..... 473/550
6,752,730 B1 * 6/2004 Brine et al. ..... 473/513

OTHER PUBLICATIONS

Webpage download, Hautestick-Titanium Railgun, 2000,http://www.hautestick.com/LaxGear/LaxShaft/RailGun/RailGun-Main.html, 2 pages.*

* cited by examiner

*Primary Examiner*—Gene Kim
*Assistant Examiner*—M Chambers
(74) *Attorney, Agent, or Firm*—Lambert & Associates; Gary E. Lambert

(57) ABSTRACT

A two-piece sports stick exhibiting a superior strength to weight ratio. A two-piece sports stick comprising two identical sections, each comprising a substantially smooth external portion and an internal portion possessing at least one cutaway; and a multiplicity of construction pegs. The sports stick of claim 1 wherein said striking surface is adaptable to multiple sports selected from the group consisting of a lacrosse head, a blade, a racquet, and a golf club head. The sports stick design allows for decreased flexure, increased rigidity and increased durability, which lend to greater generation of force, accuracy, reliability and longer life expectancy. The sports stick also affords enhanced strength in the direction of a shot and receipt of a pass. The sports stick also provides for channeling away of fluids throughout the length of the stick.

16 Claims, 13 Drawing Sheets

TWO PIECE SPORTS EQUIPMENT STICK WITH INTERNAL TRUSS CONSTRUCTION AND VENTED HANDLE

FIELD OF THE INVENTION

The present invention relates generally to sporting goods, namely sticks, shafts and bats for sports such as hockey, lacrosse, field hockey, golf, baseball, softball, polo and fishing.

BACKGROUND OF INVENTION

As designs of sports shafts, stick and handles continue to evolve at a rapid pace, clearly concurrent with the rise in popularity of such sports as lacrosse, such factors as quality, strength, weight, handling and susceptibility to failure drive the onslaught of new designs. Presently, as the design of sticks in many sports gravitates from utilizing mere composites featuring plastic outer surfaces with inner cores of wood or aluminum, versatile designs are being crafted in order to employ new shapes, materials and forms of construction.

The utility U.S. Pat. No. 4,739,994 issued to Lewis discloses a lacrosse stick having an octagon or elliptical shape where the stick is graphite loaded to increase elasticity and strength. Although the admixing and molding of graphite and plastic has merit regarding weight requirements, the same basic solid frame is utilized and thus aerodynamic and flexure advantages are not reached.

Moreover, the utility U.S. Pat. No. 3,702,702 issued to Hoult reveals a handle with a plastic tube with inwardly extending ribs that engage a rod for strength. Once again with this design, strength to weight ratio may be enhanced, but aerodynamic and flexure characteristics are not addressed.

What is needed is a design of sports stick or shaft possessing the requisite strength and durability characteristics of a metal handle and the weight, handling and production characteristics of a plastic handle has not been available.

Prior to the introduction of the present invention, the major focus has lied mainly in matters concerning materials to be utilized to minimize weight, as opposed to structural and aerodynamic considerations. The instant invention combines the material breakthroughs developed over recent shaft design with the obvious advantages of aerodynamic research.

For these reasons, a stick or shaft with a focus on creating the lightest weight yet possessing advanced aerodynamics and user safety is needed. Additionally, a two-piece sports equipment stick possessing a truss construction for rigidity, strength and weight consideration while still possessing a smooth external profile for handling and safety purposes is needed. Furthermore, a sports stick with a vented handle is needed.

SUMMARY OF THE INVENTION

The present invention reveals the next generation in sports shaft and stick technology. The instant design features internal trusses and curved cutaway surfaces to add strength and reduce weight in conjunction with small through slots in a substantially smooth external profile to provide aerodynamic airflow. These capabilities are not revealed by any prior patents. The instant invention is designed with both concave and convex internal surfaces to enhance the strength of the handle in all directions. This concept utilized in the instant invention follows the design of an aircraft wing, where strength to weight ratio is extremely important.

The present invention utilizes the airfoil shape, typical in airplane wing and fuselage design, to create a superior stick profile in regard to airflow considerations with the addition of slot cutouts in the substantially uniform smooth external surface. By incorporating this airfoil concept into material cutaways manufactured in a truss-like structure, through either the whole or some portion of the stick, the resultant combination of the aerodynamic advantages and the strength inherent in the curved truss surfaces, provides a drastically upgraded sport stick. Further, incorporating modern material considerations into the instant design only serves to render a lighter, stronger stick.

It is an object of the present invention to provide a multi-application sports stick or shaft that exhibits superior durability. It is an object of the present invention to provide a multi-application sports stick or shaft that exhibits the feel and handling capabilities of a lightweight shaft at heavier weights, due to the airfoil design.

It is an object of the present invention to provide a multi-application sports stick or shaft that exhibits the feel and handling capabilities of a lightweight shaft and delivers greater force to an object to be moved due to the truss and airfoil design.

It is an object of the present invention to provide a multi-application sports stick or shaft that exhibits superior handling and response capabilities than prior designs. It is another object to allow the user to know the position of head or striking surface at all times without having to view the head or striking surface. It is another object to minimize loss of energy on the back stroke.

It is another object of this invention to maximize the force generated by creating a more rigid shaft and thus losing less energy on the back stroke. It is another object of this invention to provide a sports stick or shaft exhibiting the rigidity characteristics of wood or heavy metals while providing the performance and operational characteristics of much lighter materials such as plastic handles or aluminum sticks or shafts.

It is another object of this invention to provide a sports stick or shaft exhibiting greater accuracy due to the rigidity characteristics of the truss structure and the inherent lack of flexure. It is another object of this invention to provide a lacrosse stick, which provides the user with a constant indication of the head position. It is another object of this invention to provide a design of stick, which utilizes enhanced carbon fiber weaves to maximum effect.

It is another object of this invention to provide a stick possessing a truss shape that can be accomplished by utilizing any number of cross sectional design schemes, including round, square, rectangular. It is another object of the invention to provide a slotted gripping area which provides enhanced stick control, a reduction in weight, enhanced airflow of the profile of the handle and a means to wick away moisture from the hands of the user.

Further, it is another object of the instant invention to eradicate problems inherent with the users digits being trapped in cutaways in the shaft, a feature particularly applicable for youth level applications. Additionally, it is an object of the instant invention to provide an external geometry which can be totally flexible in shape and design while eradicating the constraints of tubular construction. Moreover, it is an object of the invention to create a design that can be manufactured in many manners, utilizing state of the art materials as well as those used in previous years.

These and other features, aspects and advantages of the present invention will become better understood with reference to the following description, claims, and accompanying drawings. Therefore, the form of the invention, as set out above, should be considered illustrative and not as limiting the scope of the following claims.

DETAILED DESCRIPTION OF THE EMBODIMENTS

Figure 1:
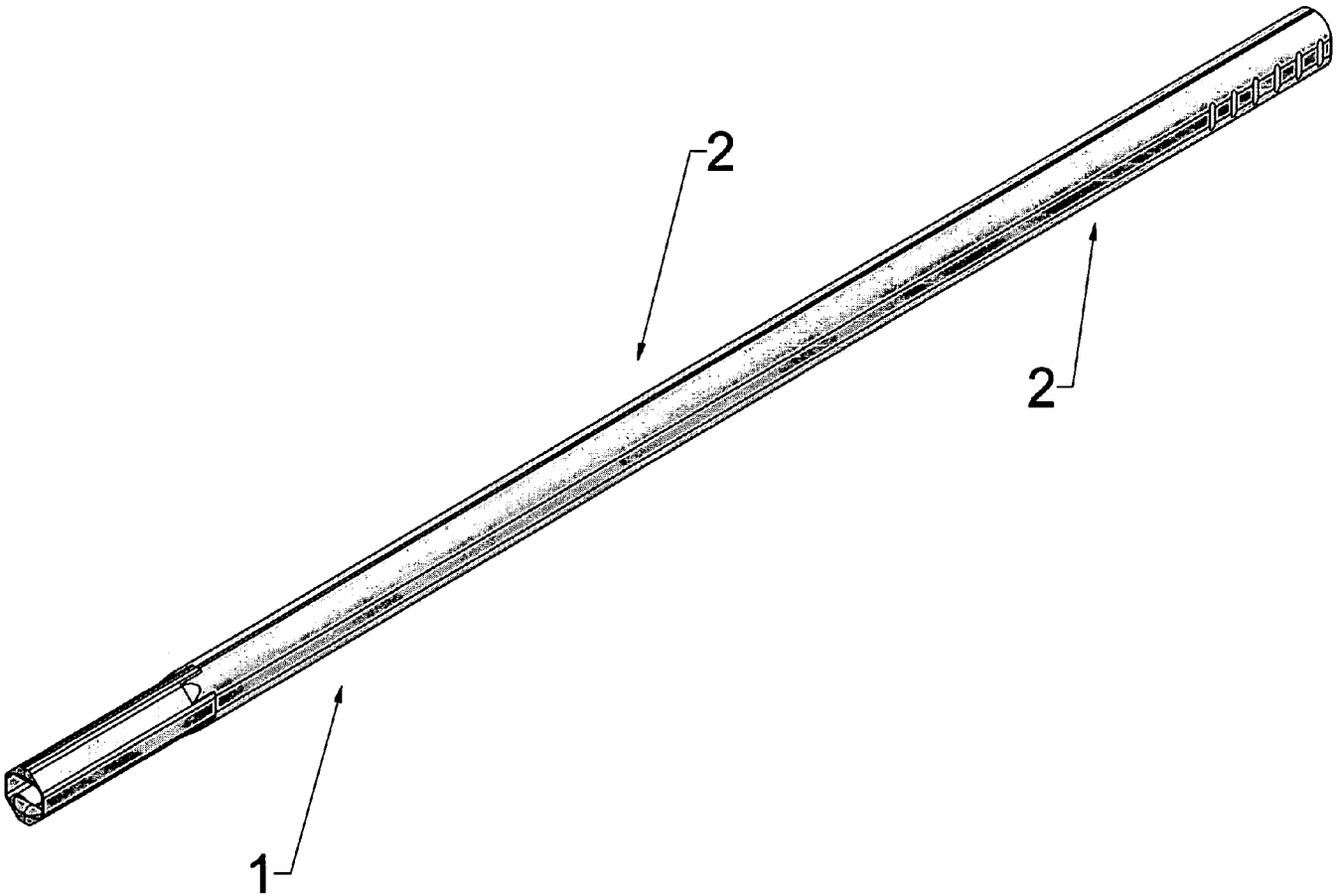
FIG. 1 hereof is an isometric view of the entire outer portion of the stick, illustrating the external portion containing a substantially smooth profile, the head attachment area and the slotted gripping area in the handle.

Referring now to FIG. 1 there is shown a sports stick construction comprising a shaft 1 equipped with an external portion 2 containing a substantially smooth profile, a head attachment area and a slotted gripping area in the handle, designed for control, reduction of weight, aeration and wicking away of fluids. The external portion 2 is not limited to any particular geometry or shape, as the external surface 2 serves to enclose the internal truss structure, described below. Furthermore, the external portion 2 can be manufactured from a myriad of materials ranging from wood to state of the art composites. Moreover, the external portion 2 can be manufactured utilizing any and all contemporary means such as machining, molding casting or extruding.

Figure 2:
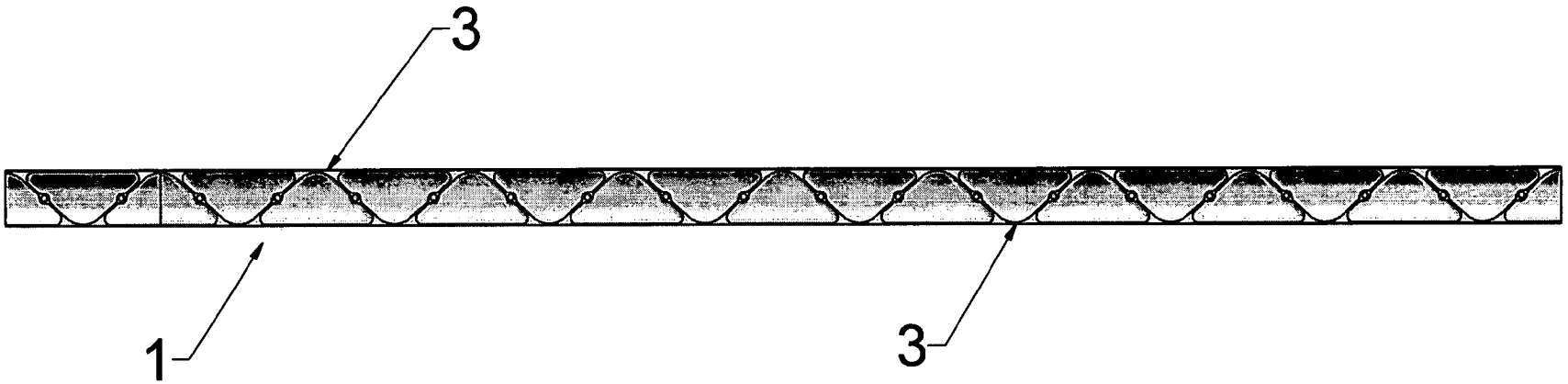
FIG. 2 hereof is a top plan cross sectional view of the stick illustrating the internal buttressing truss structure.
Figure 3:
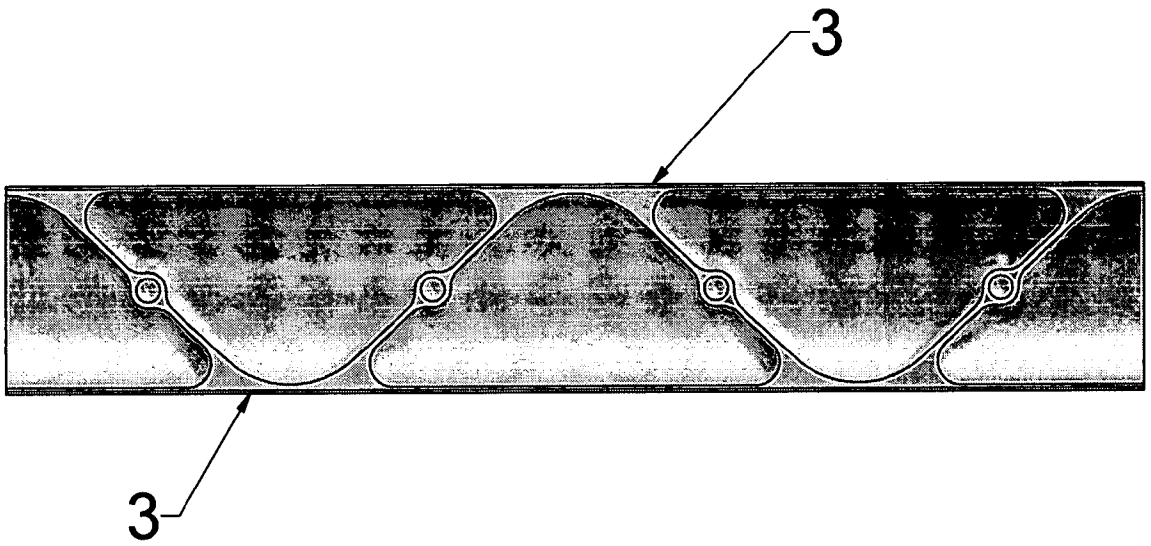
FIG. 3 hereof is a top plan exploded cross sectional view of a section of the stick illustrating the internal portion, including the buttressing truss structure.
Figure 4:
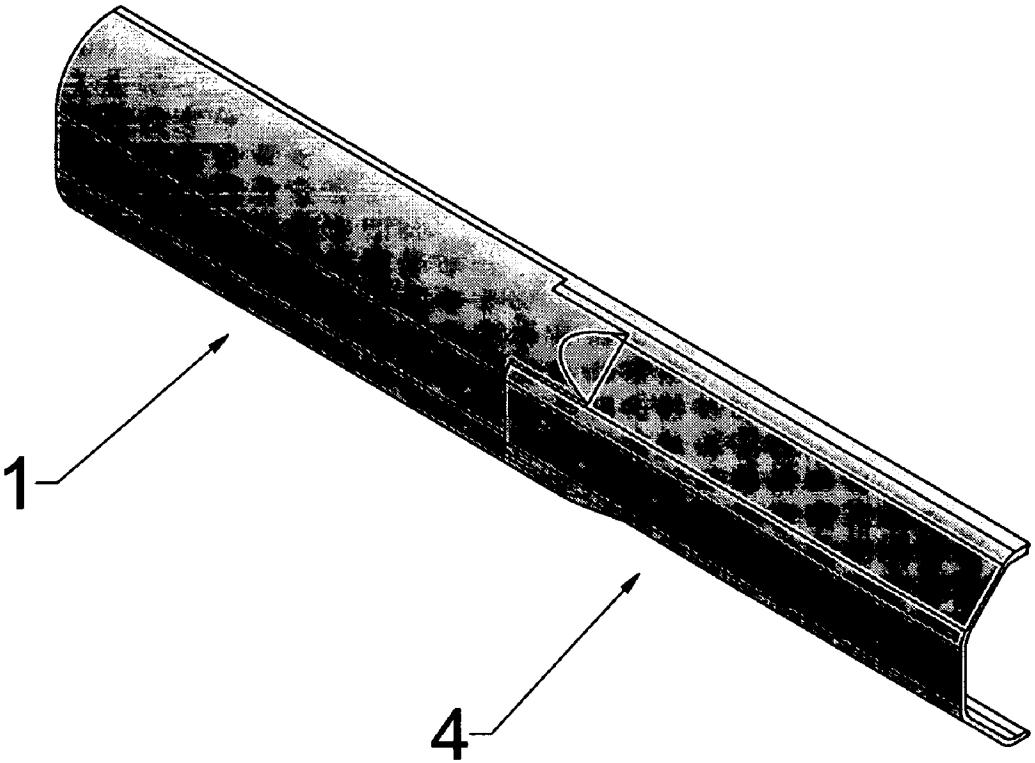
FIG. 4 hereof is an isometric, exploded view of the lower external section of the stick, illustrating the junction between the stick and the head attachment area.

Next, FIG. 2 demonstrates a top plan cross sectional view of the stick 1, illustrating the internal truss portion 3 which is designed as a buttressing truss structure. In FIG. 3, a top plan exploded cross sectional view reveals a section of the stick illustrating the internal truss portion 3, design to be a flexible buttressing structure. Further, FIG. 4 represents an isometric, exploded view of the lower section of the external portion of the stick, illustrating the junction between the stick 1 and the head attachment area 4.

Figure 5:
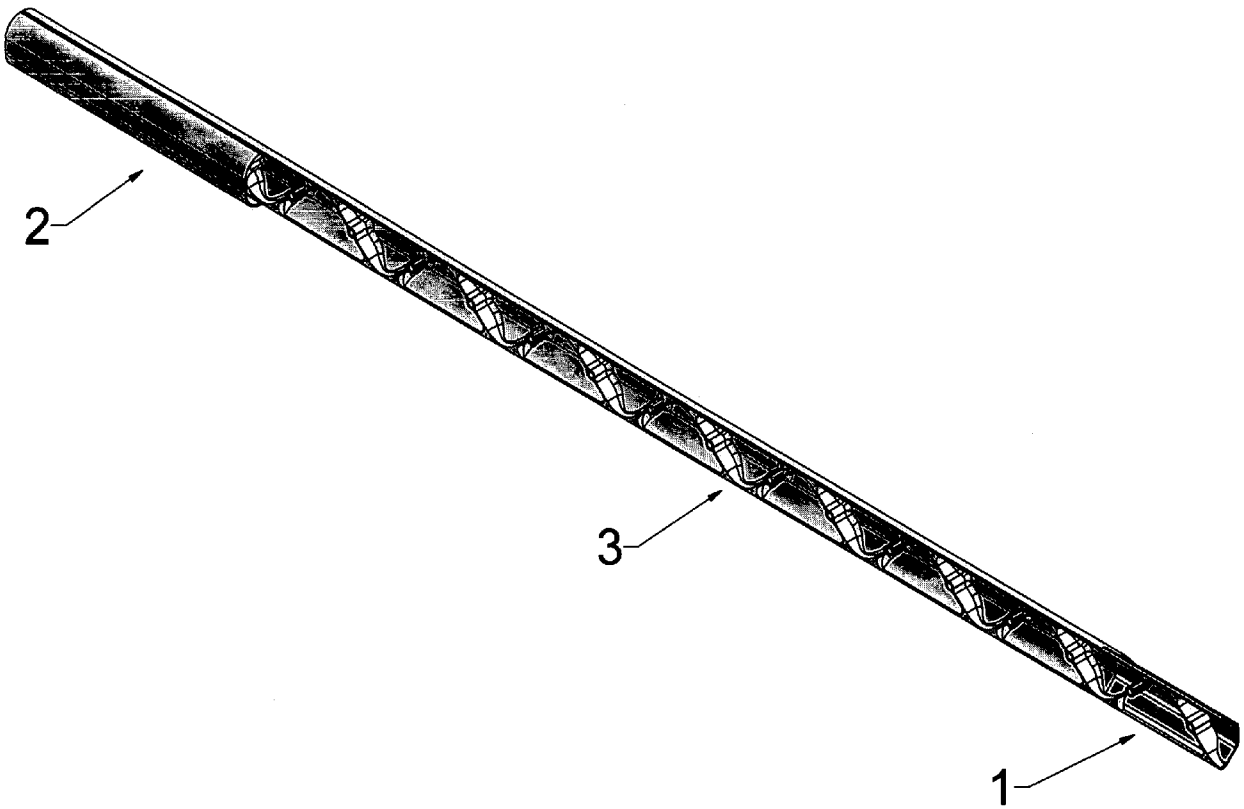
FIG. 5 hereof is an isometric, cross sectional view of a section of the stick illustrating the relationship of the external portion containing a substantially smooth profile to the internal portion, including the buttressing truss structure.

In FIG. 5, an isometric, cross sectional view of a section of the stick 1, the relationship between the external portion 2 containing a substantially smooth profile and the internal truss portion 3, including the buttressing structure is illustrated. The instant design incorporates the desired rigidity, strength and weight capabilities of inventions incorporating truss structures through arcuately interconnected triangular sections 5, yet affords the user protection from accidental injury that could occur.

Figure 6:
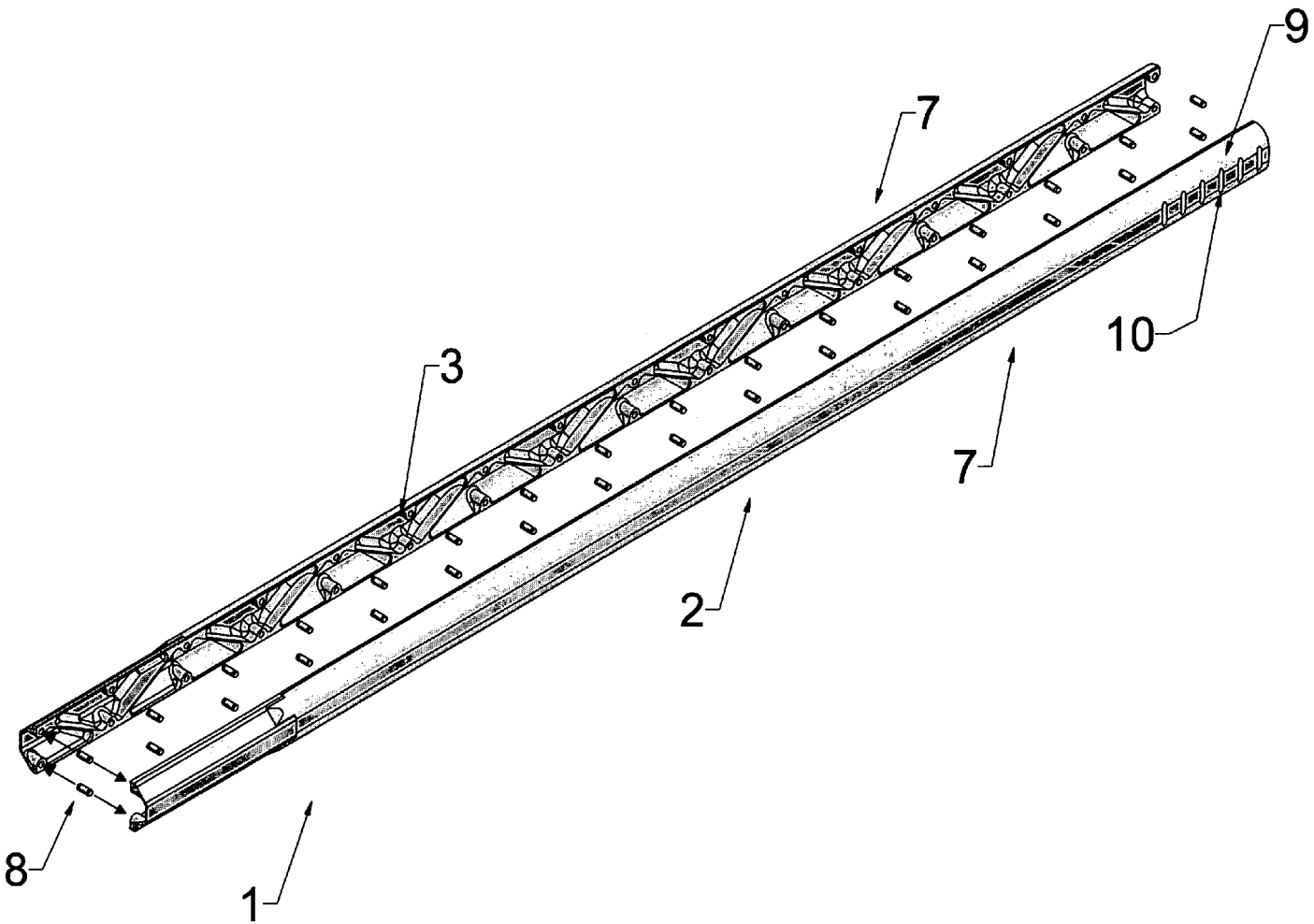
FIG. 6 hereof is an isometric, exploded view illustrating the entire stick separated into two half components and also illustrating the construction pegs utilized in joining the two half components to create a full stick.
Figure 7:
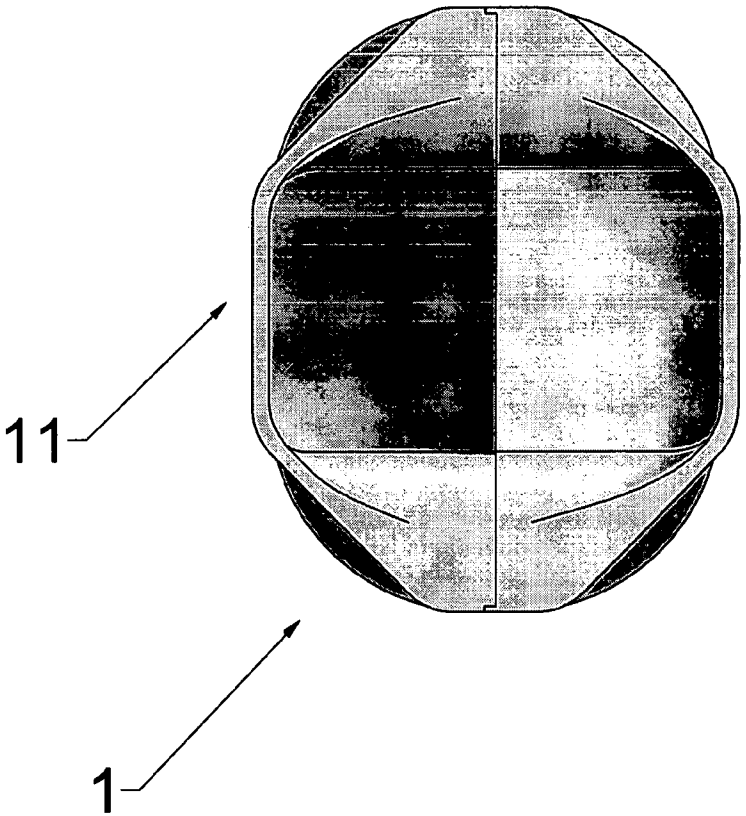
FIG. 7 hereof is a side view looking down the shaft, which is rotated 90 degrees, illustrating the geometry of the top portion of the handle.
Figure 8:
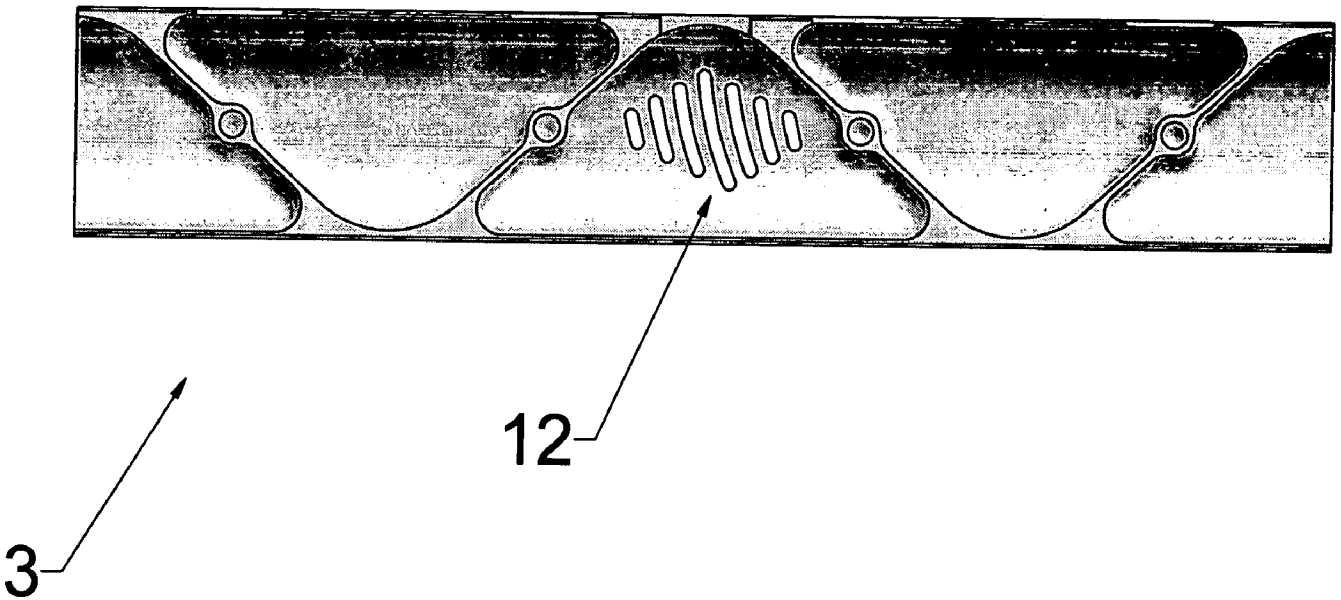
FIG. 8 hereof is a top plan, exploded cross sectional view of a section of the stick illustrating the through slots contained in the external portion for reduction of weight and aeration purposes.

Next, FIG. 6 embodies an isometric, exploded view illustrating the entire stick 1 separated into two half components 7 and also illustrating the construction interlocking pegs 8 utilized in joining the two half components to create a full stick. Further illustrated is the handle 9 with the through slots 10 designed for control and gripping, aeration, and wicking away of moisture from the hands of the user. FIG. 7 represents a side view looking down the shaft, which is rotated 90 degrees, illustrating the geometry of the top portion 11 of the handle. FIG. 8 embodies a top plan, exploded cross sectional view of a section of the stick illustrating the size staggered through slots 12 contained in the external portion, which provide weight reduction and aeration, while not subjecting the user to any danger to fingers.

Figure 9:
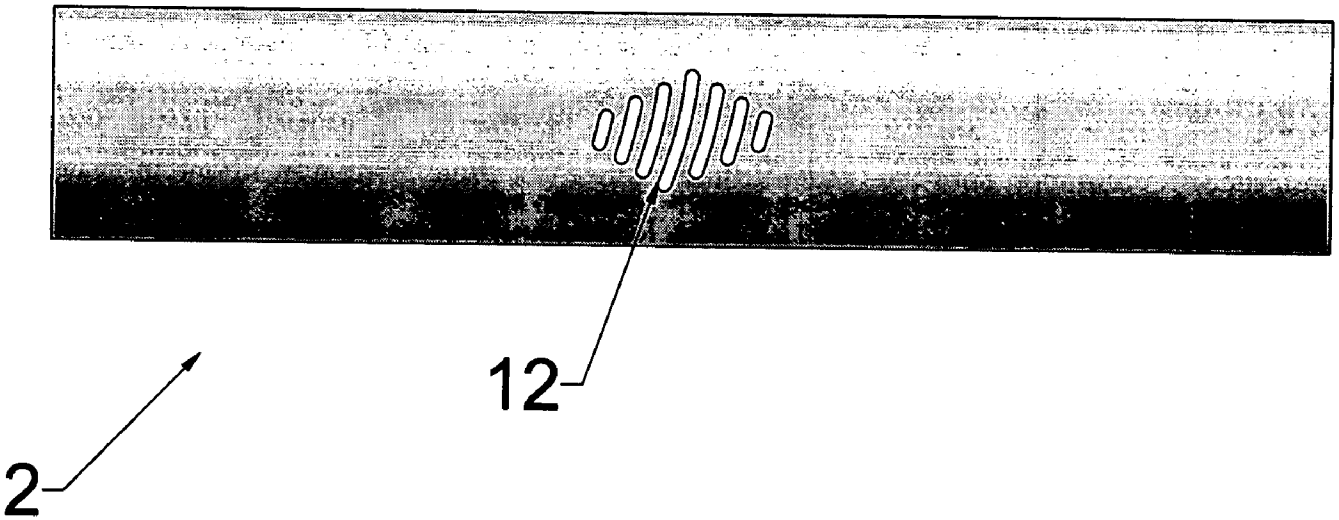
FIG. 9 hereof is an exploded top plan view of a portion of the stick illustrating the through slots contained in the external portion for reduction of weight and aeration purposes.
Figure 10:
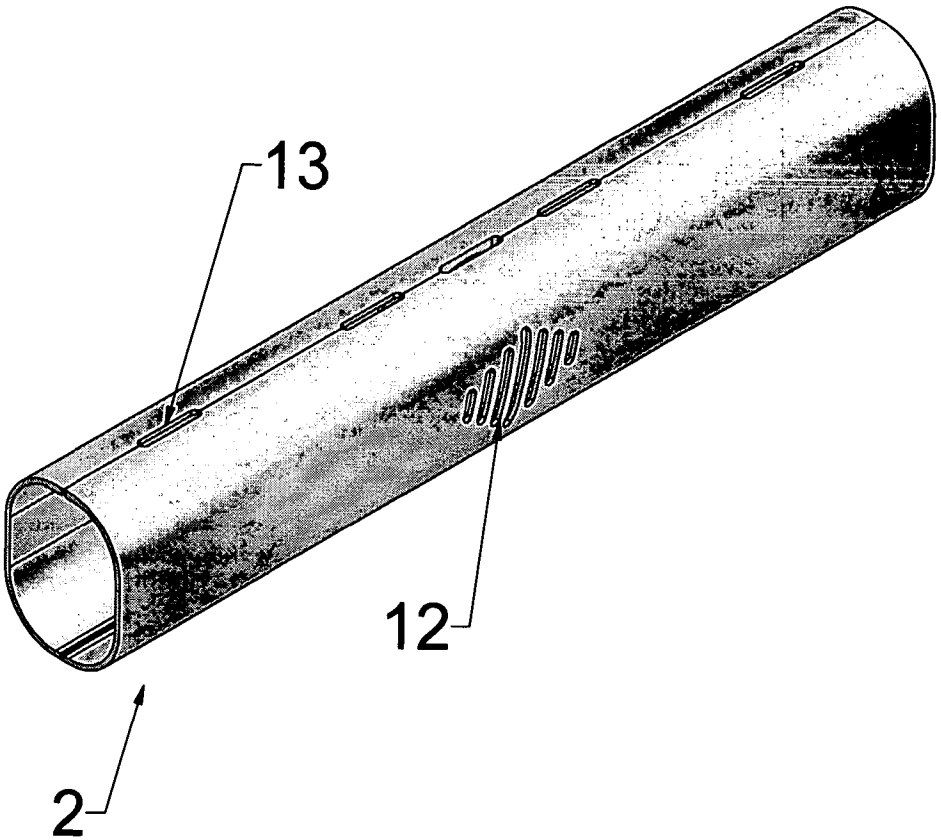
FIG. 10 hereof is an exploded isometric view of a section of the stick illustrating the through slots contained in the external portion for reduction of weight and aeration purposes and the longitudinally placed through slots located along the axis of connection of the external portion halves.

Further, FIG. 9, an exploded top plan view of a portion of the stick illustrates the through slots 12 contained in the external portion for weight and aeration purposes. FIG. 10 denotes an exploded isometric view of a section of the stick further illustrating the size staggered through slots 12 in the on the side of the external portion for weight and aeration purposes; and also illustrating the longitudinally placed through slots 13, which are also utilized for weight reduction and airflow purposes.

Figure 11:
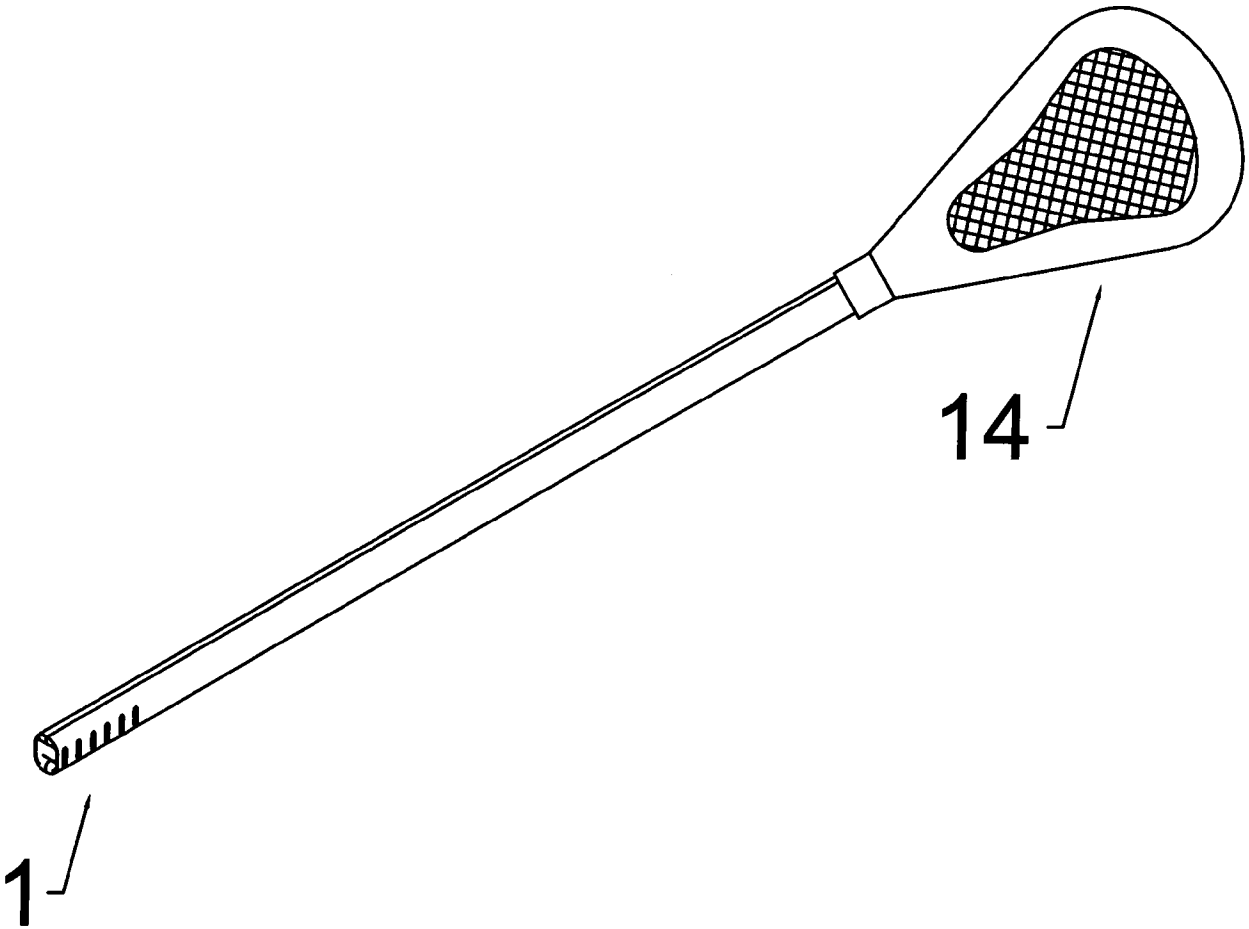
FIG. 11 hereof is a top plan view of the stick with an attached lacrosse head type striking surface.
Figure 12:
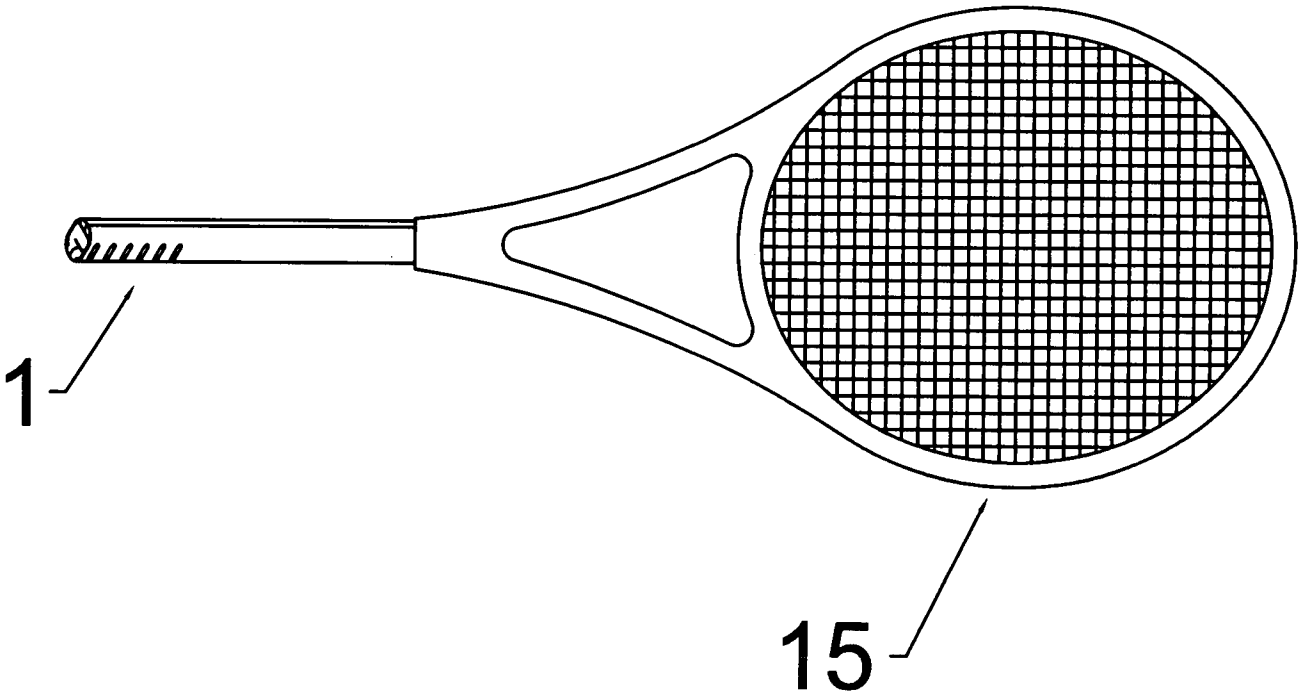
FIG. 12 hereof is a top plan view of the stick with an attached racquet type striking surface.
Figure 13:
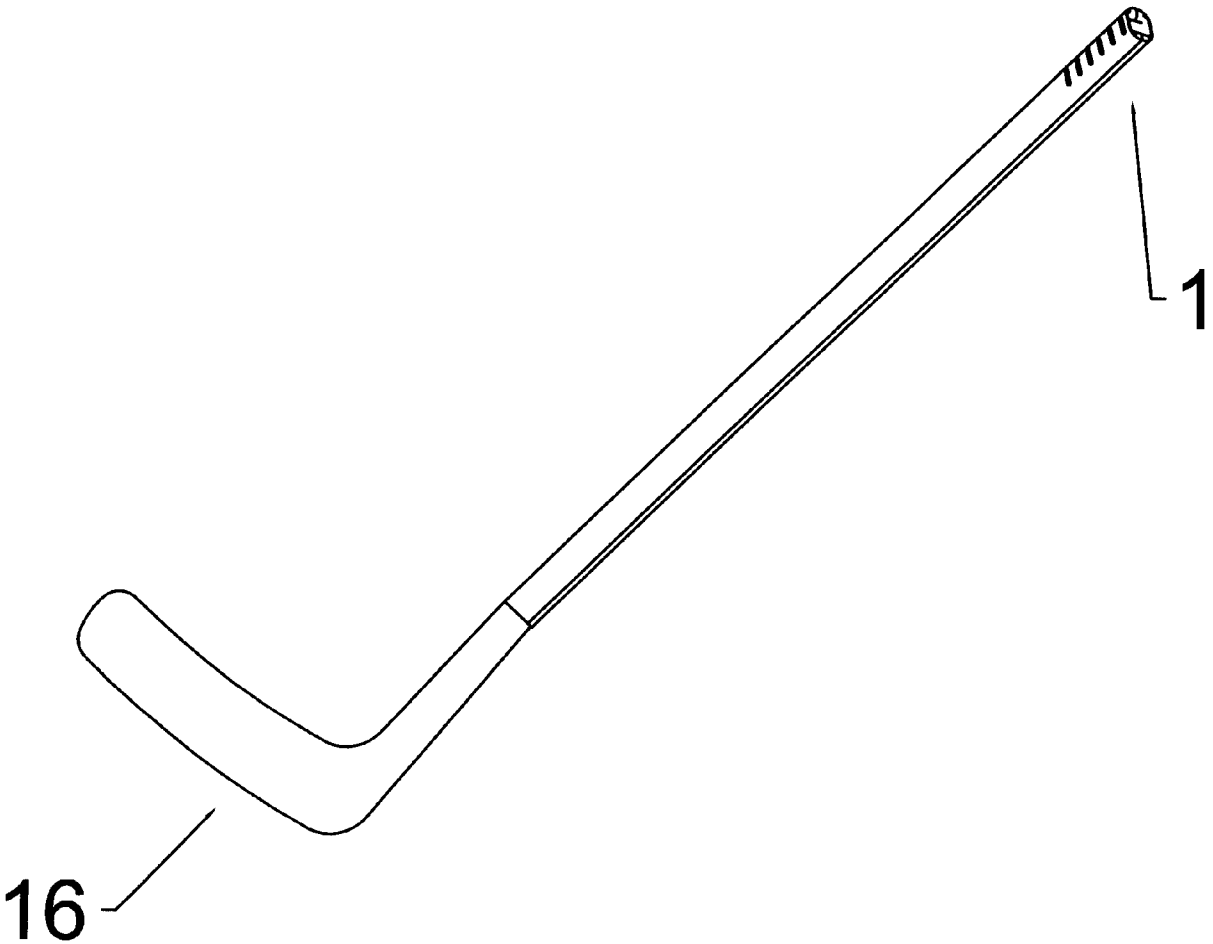
FIG. 13 hereof is a top plan view of the stick with an attached blade type striking surface.

FIG. 11 a top plan view of the stick demonstrates an attached lacrosse head type striking surface 14. FIG. 12 embodies a top plan view of the stick with an attached racquet type striking surface 15. Finally, FIG. 13 hereof is a top plan view of the stick with an attached blade type striking surface 16.

The novel design of the instant invention is no way limited regarding basic shaft shapes or materials to be utilized in manufacturing the shaft. The sports stick may possess an external surface, which is cylindrical in shape. Additionally, the sports stick may possess an external surface, which is hexagonal in shape. Further, the sports stick may possess an external surface, which is cylindrical in shape. Thus, the stick can embody any multisided shape to accommodate differing head types.

In one embodiment, there exists a sports stick comprising a handle and a shaft, comprising an internal portion and an external portion. The external portion of the stick may contain a substantially smooth profile and is not restricted to any specific geometry. The external are may also include staggered through slots in the on the side of the external portion for weight and aeration purposes. Further through slots, placed longitudinally where the two pieces intersect upon attachment. These slots are also utilized for weight reduction and airflow purposes.

The internal portion of the stick may include at least one cutaway area for weight reduction and rigidity enhancement. The internal portion may further contain a multiplicity of cutaway areas. The sports stick may further contain a multiplicity of curved cutouts. These curved cutouts may be in the shape of an airfoil and the multiplicity of cutouts can be designed to form a truss structure, which allows internal flexure while maintaining rigidity. Thus, the novel invention enhances structural integrity, especially in the vectorial direction of the force exerted on the object to be moved, while also allowing for flow of air directly through the structure of the stick of a greater volume than the flow along the outer edges of the stick.

Further in regard to structural integrity, upon contact with an obstacle, due the curved, truss-like structure, the shaft will exhibit a tortional or rotational action, instead of the usual buckling effect of a cylindrical member. Also, due to the truss structure, the instant shaft will not buckle upon receiving a dent on the field of play. A further important attribute inherent in the instant invention centers around superior durability and greater longevity of the shaft, due to the rigidity and rotational characteristics of the truss structure. The lack of flexure also assists with the orientation and head alignment toward recovery of ground balls. The torsion affect also assists the user during faceoffs and alignment of head to ground to compensate for the recovery of ground balls. Additionally, the truss structure does allow for flexure in the planes 90 degrees away from the striking direction and receiving direction. Thus, the instant stick will still have the flexure needed for checking, while retaining the stiffness for maximum striking and receiving characteristics.

A major advantage of the truss structure surfaces centers around upon receipt of a pass by the user. Utilization of the truss configuration greatly minimizes the flexure present upon receiving a pass. Thus, the user does not lose position, momentum or control, even when the object received is traveling at a great velocity.

Further the instant stick may include a multiplicity of grooves extending along the entire length of the shaft in order to channel water away from the gripping surfaces. The indentation of the internal cutaways also inherently serves to assist in water removal during inclement weather by providing a roll off area and also less surface for water to accumulate upon. Prior designs attempting to utilize grooves only possess grooves along the handle area and fail to incorporate the cutaway areas. Thus, water is allowed to collect at the end of the gripping area.

Further, the grooved gripping area, along with the shape accomplished with the cutaway areas introduced in the instant invention prevents the shaft from rotating out of the hand of the user since the cutaway areas provide a positive grip not found on basic polygonal shaped shafts. Thus, this positive grip, in combination with the truss structure helps to prevent head and shaft rotation upon receipt of a pass, and thus affords the user far greater control of the shaft. Moreover, the cutaway design and the location of the grips on opposing sides of the shaft serves to consistently indicate the orientation of the striking surface or head of the invention due to the location. Thus, a user never has to glance at the stick in order to know that the head is in proper striking position.

An additional important attribute of the instant invention appears in the minimization of flexure due to the curved surfaces in the form of a truss. Thus, on the wind up and follow through during the delivery of a strike, flexure of the stick is minimized. Thus, the user does not have to compensate for a major backward force upon the backstroke and thus, this lack of flexure in combination with the maximized shaft velocity inherent with the curved cutout design insures that the force upon strike is maximized.

It is an object of the present invention to provide a multi-application sports stick or shaft that exhibits the feel and handling capabilities of a lightweight shaft even at heavier weights, due to the airfoil design. Thus, although the user will gain more power from the heavier shaft, the aerodynamic capabilities of the shaft will create a lighter feel during play and thus tend not to tire the user.

Further, among the utmost facets of the instant invention centers around the inherent ability of the instant shaft to be to be manufactured from dissimilar materials. Due to the properties intrinsic in single shape, cylindrical type shafts, prior shafts are presently unable to be manufactured from dissimilar materials. This capability allows the present invention to utilize the strengths of different materials in both the operational and the aesthetic realm. For example, certain users may favor the feel or other characteristics of a wooden handle. Thus, the instant invention can feature differing raw materials such as wood, polymers, light metals, heavier metals, carbon fibers and composites, all utilized in concert to produce a desired result. For example the raw materials that can be combined to create a shaft are not limited to, but could include, plastic on two sides with wood in between to create a different feel, and still optimize weight and rigidity characteristics.

In regard to manufacturing attributes, the novel stick may be manufactured from any material, including but not limited to aluminum, titanium, composite graphite and carbon fiber. Additionally, the stick may be produced of tubular shaped raw, even dissimilar materials or components in the shape of squares, rectangles, rounds, or hexagons. Due to the novel, non tubular design of the instant invention, in regard to methods of production, the shaft may be manufactured from dissimilar materials and shapes of material, joined together by methods, including but not limited to welding, bonding, brazing, screwing and mechanical fastening subsequent to dovetailing. Thus the instant invention is not limited the use of one type, or especially one shape, of raw material and is thus not limited by the design and production restrictions inherent with those shapes or materials.

Investigating the features that contribute to the superior operational capabilities of the novel shaft, analysis of the invention in consideration of the laws of physics reveals why this invention provides a faster and more accurate strike. Considering the force generated and imparted upon an object to be projected, force is a vector quantity, having both magnitude and direction. The basic equation for force is as follows: $F=\text{mass}\times\text{acceleration}=m(a)$ in units of $kg\times m/sec^2$. Thus, if the acceleration could be held constant, the force applied to the ball from the shaft would naturally be greater when a heavier shaft is utilized, since the mass component will be greater than that of a lighter shaft.

In prior designs, due to the constraints inherent with a human user, a loss of acceleration would naturally occur due to the greater shaft mass, since the user can only achieve a maximum moment based on the weight of the shaft. However, the instant design solves this problem through utilization of aerodynamic principles. Due to the airfoil shaped cutout design, as evinced in basic aerodynamic terms, the velocity achieved would be greater as the airfoil exhibits the greatest possible airflow over an object. Prior shafts were designed with cylindrical, hexagonal or some form of polygonal profile. Where the instant invention offers adaptation of similar external profiles, the additional integration of a series of internal airfoil and circular shaped ports channeled through the material creates a far superior flow path. Simply put, the flow directly through a series of smooth airfoils and cylinders is significantly less turbulent than the flow over a solid cylindrical member, as there will be less breakage in the laminar boundary.

Thus the overall airflow around and through the instant invention is dramatically enhanced when compared to the flow over a solid cylindrical member. Thus, these flow advantages clearly translate into greater shaft velocity and acceleration.

Thus, even when a metallic material is chosen from which to manufacture the shaft, the greater acceleration and velocity from the aerodynamic advantage will more than compensate for the slight additional weight. Thus, with a heavy shaft, the force delivered to move an object will be maximized. Conversely, when lighter materials are used, the advantage of the instant design can only greatens as the far greater acceleration drastically surpasses the lighter weight in the equation of force generated.

Further investigating momentum considerations, in mechanics, momentum is the quantity of motion of a body, specifically the product of the mass of the body and its velocity, (mass×velocity=kg×m/sec). Momentum is a vector quantity and thus possesses both a magnitude and a direction, the direction being the same as that of the velocity vector. When an external force acts upon a body or a system of bodies in motion, it causes a change in the momentum of the body. The impulse of a force, acting on a body, is the product of the force and the duration of time in which it acts and is equal to the change in momentum of the body. Clearly, following the above analysis, the momentum obtained by the ball should thus be increased by the novel design.

Further and of great import regarding any sports stick are rigidity considerations. Regarding rigidity and the novel truss like design of the instant shaft, engineering principles have long evinced the strength of truss structures, especially where weight considerations are significant. Thus, the instant invention creates a light-weight stick, without sacrificing strength. Additionally, as important as strength considerations are to a sports stick, rigidity as opposed to flexure considerations, run hand in hand and often dictate the performance level of a sports stick. Prior art solid shafts exhibit a great amount of flexure due material considerations exhibited by solid materials. However, truss structures evince minimal flexure due the interplay of the materials expansion in to areas where cavities exist.

Further, the sports stick can be a lacrosse stick comprising a shaft wherein the shaft includes at least one internal portion containing an area for mounting a striking surface at least one cutaway area and an external surface and a striking surface. Additionally, the sports stick can be a hockey stick comprising a shaft wherein the shaft includes at least one internal portion containing an area for mounting a striking surface at least one cutaway area and an external surface and a striking surface.

The lack of flexure innate with a truss design serves to minimize the natural loss of energy occurring on the back or windup stroke during normal usage of the shaft. As such, the user progresses into the throwing stroke without the need to compensate for or overcome a huge loss of energy due to flexure. Thus, the lack of flexure allows the user more time and accuracy since the shaft will not flex during a shot and therefore the ball is more likely to arrive at its intended target.

Moreover, due to the ridged curved truss design, the instant invention is extremely durable and thus, unlike other tubular shaped handles, this design will not buckle and bend when dented under normal playing conditions. The truss system also allows for a slight twisting or rotation of the handle to allow the head to adjust to the playing surface when retrieving a ground ball or striking an object and colliding with any surface.

Therefore, the internal truss design, in conjunction with the external skin, provides bi-directional maximum strength with out exposure to injury to the user. Finally, there are no limitations to the internal truss shape or design as the truss can be configured to provide the maximum strength and ideal weight.

What is claimed:

1. A sports stick comprising:
a handle portion; and,
a shaft portion comprising:
a substantially smooth external surface, and
an internally disposed support structure comprising a plurality of substantially triangular areas disposed to provide a support structure for said substantially smooth external surface wherein said plurality of substantially triangular areas comprise radial edges wherein said radial edges define an upper and a lower portion of said plurality of triangular areas and wherein said radial portions connect said upper portions of said plurality of triangular areas to said lower portion of each adjacent triangular area.

2. The sports stick of claim 1 wherein said substantially smooth external surface comprises ten side portions.

3. The sports stick of claim 2 wherein said internally disposed support structure is mounted to opposing sections of said substantially smooth external surface.

4. The sports stick of claim 3 wherein said plurality of substantially triangular areas converge with six of said ten sides.

5. The sports stick of claim 4 wherein said handle portion comprises a multiplicity of rectangular grooves comprising semi circular end portions, said rectangular grooves disposed perpendicular to the longitudinal axis of said handle portion.

6. The sports stick of claim 5 wherein said multiplicity of grooves is located on opposing sections of said handle portion in order to consistently orient the striking surface of said sports within the hand of a user.

7. The sports stick of claim 6 wherein said substantially smooth external surface is comprised of a material which differs from a material from which said internally disposed structure is comprised.

8. A sports stick comprising:
a handle portion; and,
a shaft portion comprising:
an external skin structure; and
a first internal support structure and a second internal support structure, separate from said external skin structure wherein said first support structure and said second support structure each comprise a series of arcuately interconnected triangular sections, wherein said first support structure is disposed to be independent and non-contacting of said second support structure; and,
wherein said first support structure and said second support structure are attached to said external skin structure.

9. The sports stick of claim 8 wherein said first support structure and said second support structure are attached to opposing sides of said external skin structure.

10. The sports stick of claim 9 wherein said external skin structure comprises a different material than a material of said first support structure and a material of said second support structure.

11. The sports stick of claim 10 wherein said first support structure and said second support structure comprise a substantially more rigid material than said external skin structure.

12. The sports stick of claim 11 wherein said handle portion comprises a multiplicity of rectangular grooves comprising semi circular end portions, said rectangular grooves disposed perpendicular to the longitudinal axis of said handle portion.

13. The sports stick of claim 12 wherein said multiplicity of grooves is located on opposing sections of said handle portion in order to consistently orient the striking surface of said sports within the hand of a user.

14. The sports stick of claim 13 wherein said first support structure and said second support structure are attached to opposing sides of said external skin structure by welds.

15. The sports stick of claim 14 wherein the shaft is manufactured from materials from the group consisting of aluminum, titanium, composite graphite, carbon fiber, polymers, wood, composite woods, ferrous materials, nonferrous materials, and stainless steel.

16. A sports stick comprising:

a handle portion; and, a shaft portion comprising:

an external skin structure; and a pair of substantially identical internal support structures, disposed to be independent and non-contacting, wherein said pair of internal support structures each comprise a series of arcuately interconnected triangular sections with radial edges; and, wherein said pair of internal support structures are attached to said external skin structure.

* * * * *